United States Patent [19]

Birkhamshaw

[11] 4,174,670

[45] Nov. 20, 1979

[54] MACHINES FOR SECURING TEXTILE FABRICS ONE TO ANOTHER

[75] Inventor: Ronald G. Birkhamshaw, Sutton in Ashfield, England

[73] Assignee: Mathbirk, Limited

[21] Appl. No.: 803,518

[22] Filed: Jun. 6, 1977

[51] Int. Cl.[2] ..... D05B 7/00

[52] U.S. Cl. ..... 112/25; 112/163

[58] Field of Search ..... 112/25, 26, 27, 155, 112/163, 262

[56] References Cited

U.S. PATENT DOCUMENTS

| | | | |
|---|---|---|---|
| 1,587,957 | 6/1926 | Huber | 112/163 X |
| 2,871,806 | 2/1959 | Bley | 112/25 X |
| 3,119,360 | 1/1964 | Mayer | 112/25 |
| 3,126,850 | 3/1964 | Sigoda | 112/163 X |
| 3,192,887 | 7/1965 | Perl | 112/163 X |
| 3,246,620 | 4/1966 | Sigoda et al. | 112/163 X |
| 3,353,510 | 11/1966 | Reeber et al. | 112/163 X |
| 3,490,396 | 1/1970 | Conti | 112/25 |

*Primary Examiner*—H. Hampton Hunter

*Attorney, Agent, or Firm*—Paul & Paul

[57] ABSTRACT

A linking machine is provided having a plurality of extending points onto which pieces of fabric to be joined are threaded. The linking machine consists of a linking station, a cutting station, and an over-sew station. The linking station has one needle and may have a pair of needles which operate to link pieces of fabric together by a single thread chain stitch, thereafter, the fabric which has heretofore been threaded on points of the dial is presented to a cutter at the cutting station which removes surplus fabric on the exposed fabric side of the linking thread whereupon the fabric remaining on the points is presented to the over-sew station having a needle which pierces the fabric then withdraws then returns over the edge of the fabric, each time being wrapped with the thread by thread guides whereupon an over-sew stitch over the edge of the fabric is formed. In an alternative embodiment, the linking machine may have a pair of over-sew needles, wherein the second needle forms an over-sew over the stitch formed by the first needle which securely locks the first over-sew thread.

7 Claims, 5 Drawing Figures

MACHINES FOR SECURING TEXTILE FABRICS ONE TO ANOTHER

Figure 1:
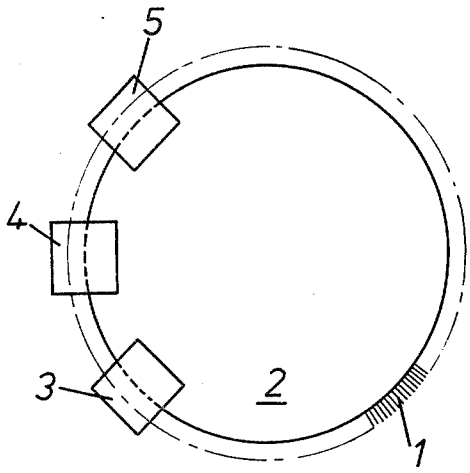

This invention is for improvements in or relating to machines for securing textile fabrics one to another and is particularly concerned with providing improvements in machines which are known in the textile trade as linking machines. It is known to secure together pieces of fabric in various different ways, depending upon whether the fabric has been cut from a piece and therefore has an unsecured edge or whether the edge of the fabric has been formed as a selvedge. In the joining together of two unselvedged edges of fabric it is necessary to link the fabric together and it is customary to run the two pieces of fabric onto points on a dial normally consisting of outwardly extending points and then to link the fabrics together by a chain stitch. Various types of apparatus and mechanisms are known for forming a chain stitch in a linking machine and for the operation of the needles and of catching the thread and wrapping it around the needle and these do not form part of the present invention.

In the joining together of two pieces of fabric with an unselvedged edge by a linking process an unsightly part of the threads or filaments forming the fabric are left extending from the selvedge and this may cause an undesirable and unsightly joint which albeit will be on the inside of the garment but which is not regarded as forming a garment of sufficiently satisfactory and pleasing appearance.

For these reasons it has been hitherto the normal practice to overlock or over cast two unselvedged edges of knitted fabric together and this overcasting consists of a combined overlocking and oversewing operation in which the two pieces of fabric are joined together by a locked thread in a sewing machine with a zig-zag stitch formation. This consists of a first thread inserted by a perforate needle which is engaged by a looper having a second thread so as to form an inextensible overlocked stitch. In order to overlock or overcast two pieces of fabric together considerable skill of the operator is required as it is necessary to feed the two pieces of fabric simultaneously to a sewing head.

It will be appreciated that where fabrics of slightly different textures and which may have been knitted on different machines are formed that different stretch qualities may result and when it is desired to join two pieces of fabric having a matched pattern it is sometimes difficult to ensure that the pattern accurately matches since although the two fabrics start together at one end by the time they have been fed to a sewing head they do not necessarily terminate at exactly the same length. Thus, miss-match of fabric patterns may result.

It is an object of the present invention to provide improvements in machines for joining together two unselvedged fabrics by the use of a linking machine and which will thus largely eliminate the need for highly skilled operatives.

According to the present invention there is provided a linking machine comprising a plurality of extending points on to which the pieces of fabric to be joined may be threaded means for linking of the pieces of fabric together by a single thread chain-stitch means for presenting the linked fabric to a cutter to remove surplus fabric on the exposed fabric side of the linking thread and then presenting the fabric to a single thread oversew station at which a needle firstly pierces the fabric then withdraws then returns over the edge of the fabric each time being wrapped with thread so as to form an oversew stitch over the edge of the fabric. In a particular construction a linking machine may have a pair of linking needles at a linking station and a pair of oversew needles at an over-sewing station which are separated by a cutter.

Desirably the points on to which the fabric are threaded are formed on a radial dial and so that the points extend radially outwards and thus an operative may be threading fabric on to the points while simultenously fabric already threaded on to the points is being linked up and over-sewn thus providing a substantially continuous process.

Alternatively, the present invention may be applied to linking bars which are a continuous straight line of points on to which the fabric is threaded and the linking bars threaded to a straight bar linking machine, cutting and oversewing stations.

The oversew station of the present invention may consist of two needles and desirably the needles are on the outside of the dial so that they pierce the fabric from the outside towards the interior and on the interior of the fabric within the dial there are yarn guides for wrapping yarn around the needles to be caught by rearwardly facing hooks in the needles.

Figure 2:
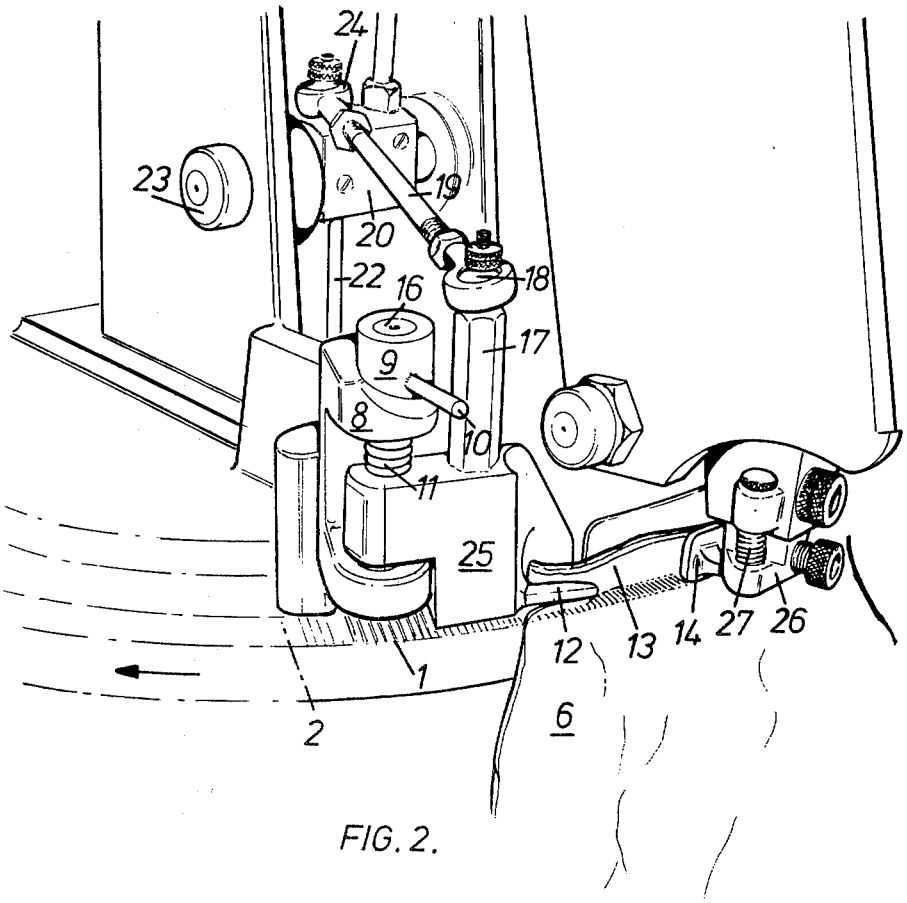
Figure 3:
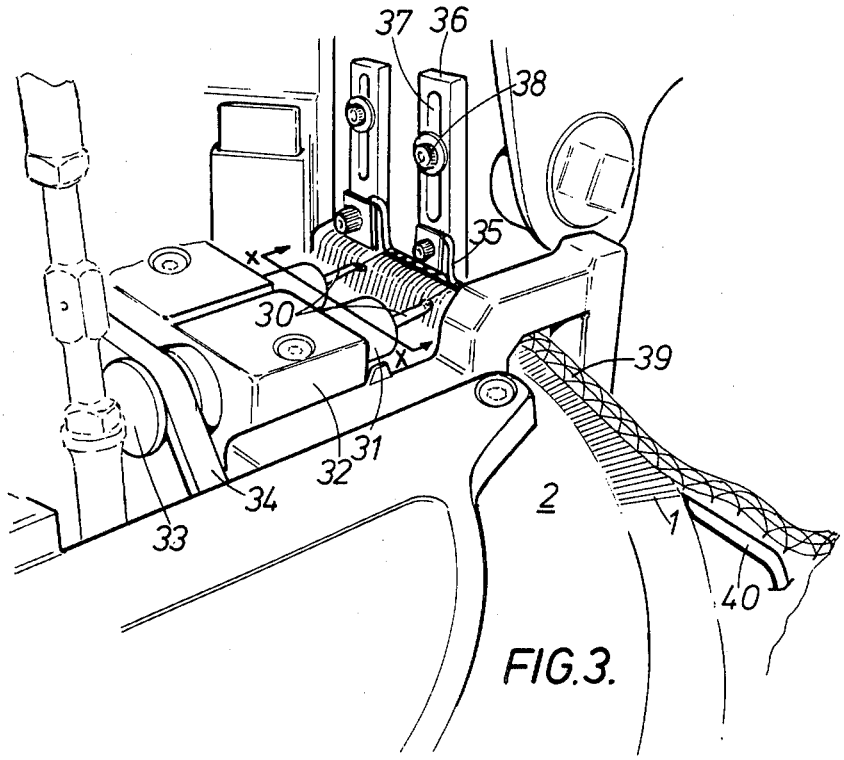
Figure 3A:
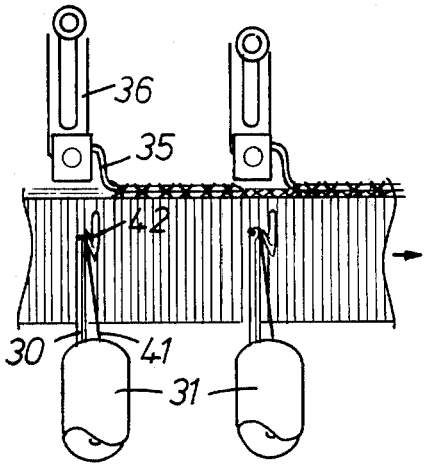
Figure 3B:
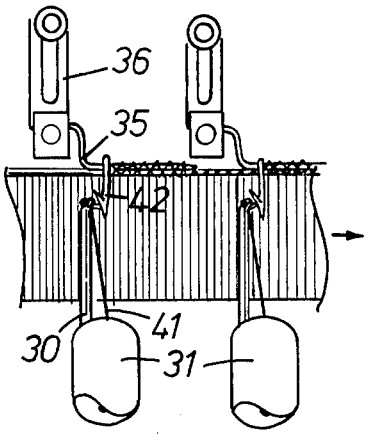

In order that the present invention may be more readily understood reference is now made to the accompanying drawings in which:

FIG. 1. is a diagrammatic plan of a layout of a linking machine according to the present invention, and FIG. 2. is a perspective view of a part thereof, FIG. 3. is a perspective view of an over-sew station according to this invention, FIG. 3*a*. is a view on the line x—x of FIG. 3 with the yarn guides in one position, FIG. 3*b*. is a view on the line x—x of FIG. 3 with the yarn guides in an alternative position.

Referring firstly to FIG. 1 a dial 2 of a linking machine is provided with a plurality of radially extending points 1 onto which fabric to be linked is threaded. The machine consists of three localities, a linking station indicated generally at 3, a cutting station indicated at 4 at which fabric surplus is removed from the linked fabric, and an over-sewing station indicated generally at 5 at which the cut edges provided at cutting station 4 are over-sewn to form a neat and secure join of the two pieces of fabric. It will be appreciated that the cutting station 4 may be omitted if desired and fabrics which have been run onto the points 1 may be linked at station 3 and then over-sewn at 5 if desired and according to the nature of the fabrics.

Referring now to FIG. 2 the dial 2 is provided with the extending points 1 as referred to with reference to FIG. 1 and pieces of fabric are indicated generally at 6 which have been impaled onto the points 1 and which fabrics have already been linked at the linking station 3. The fabric is held against a rim of the dial by a foot 14 which may be adjusted vertically relative to a block 26 by adjustment of a screw surrounded by a coil spring 27. A cutting member 12 is adapted to reciprocate so as to remove surplus fabric 13 from the linked fabric 6. Cutter 12 is mounted on a member 25 which is pivoted on a pin 16 held in a yoke 8 secured to the frame of the machine. The cutter may be raised and lowered relative to the fabric 6 by rotation of a bush rotatiable on the pin 16 and having a radial extending arm 10. The bush 9 is adapted to co-operate with a sliding cam surface of the yoke 8. A coil spring 11 is provided to bias the member 25 into the lower position at which the cutter 12 operates to remove the surplus fabric 13. The cutter 12 may be raised into an imperative cutting position by rotation of bush 9 on the cam surface on yoke 8.

It will be appreciated that cutter 12 acts in conjunction with a sole plate (not shown) to ensure a clean cut of the fabric. Means may be provided for adjusting the height of the sole plate to vary the height of surplus fabric 13 which is cut. A pillar 17 upstands from the member 25 and is provided with a ball coupling 18 to a rod 19 similarly coupled by ball coupling 24 to a block 20. The block 20 is rotatedly mounted on an axis 23 and a push rod 22 acts on the block 20 to reciprocate the block 20 about the axis 23. This reciprocatory movement results in a to and fro movement of the pillar 17 about the pin 16 thus forming a sideways movement of the cutter-blade 12 to ensure clean cutting of surplus fabric 13. From the cutting station the fabric passes to an over-sew station which may consist of two needles and desirably the needles are on the outside of the dial so that they pierce the fabric within the dial; there are loop threaders for wrapping the thread around the needles where they may be caught by rearwardly facing hooks on the needles.

The over-sew station is more particularly illustrated in FIGS. 3, 3*a* and 3*b*. Needles 42 with hooks (not shown in FIG. 3) first pierce the fabric and thread guide 30 wraps yarn 41 around the extending shank of the needle so as to engage the needle hook. The thread guides are mounted in bushes 31 which are rotatable within a bearing housing 32 by a belt 34 driving a pulley 33 fast with the bushes 31 (FIG. 3*a*).

The needles then withdraw the yarn through the fabric and then extend forwardly over the fabric and over a tension bar 35 mounted on a slide 36 adjustable by screw 38 engaging in a slot 37 found in the slide. The thread guides again wrap thread around the needle shanks so as to be caught by the needle hooks and the needles again withdraw over the tension bar 35 (FIG. 3*b*). The old loop is cast off each time the needles 42 advance. The result is at an over-sew stitch of a single thread. If two needles are provided as illustrated herein the second needle forms an over-sew over the stitch formed by the first needle, thus securely locking in the first over-sew thread. The fabric with the over-sew 39 is then guided off the points 1 by a fabric guide 40.

It will be appreciated that the tension of the thread at the over-sew station is adjustable by raising or lowering of the tension bar 35 in the slide 36 so as to draw more thread during the formation of the over-sew stitch. In some instances a relatively loose over-sew stitch is required to give greater extensibility to the fabric guide than in other cases.

It will be appreciated that in some instances it is desirable to join together two selvedged fabrics such as for example, forming collars for V-necks, turtle necks and polo neck sweaters which are then subsequently joined to a neck opening.

In such instances it is possible to run on the selvedge edges of the fabric on the points and by disconnecting the linking and cutting operation merely run the fabric through the over-sew station which the edges of the fabric will be joined together to form a substantially flat uniform seam which renders a polo-neck collar considerably more sightly than hitherto known processes often involving hand sewing and which provides a more uniform product since the two lengths of the collar to be joined together are run on to the points and thus accurately positioned as to length for joining together. The use of running the pieces of fabric whether selvedged or un-selvedged on to the points prior the linking, cutting and/or over-sewing results in accurate pattern matches being obtained when joining together the pieces of fabric.

What we claim is:

1. A linking machine for securing two or more pieces of textile fabric together comprising:

a plurality of extending points onto which said pieces of fabric to be joined may be threaded;

means for linking of said pieces of fabric together by a single thread chain stitch;

cutter means for removing surplus fabric on the exposed fabric side of said linking thread;

over-sew means, including a needle and thread guide means for wrapping thread around said needle, said over-sew means for forming an over-sew stitch over the edge of said fabric, wherein said needle first pierces said fabric whereupon said thread guide wraps said thread around said needle, said needle then withdrawing from said fabric and then returning over the edge of said fabric whereupon said thread guide again wraps said thread around said needle and said needle is withdrawn over the edge of said fabric; and means for presenting said link fabric to said cutter and for presenting said fabric to said over-sew means.

2. A machine according to claim 1 in which the cutter means comprises a movable cutter blade for removing surplus fabric on the exposed of the linked fabric.

3. Apparatus according to claim 1 in which the cutter blade is reciprocated about a vertical axis by means of a push-rod mechanism.

4. Apparatus according to claim 1 wherein said over-sew means include a pair of over-sew needles.

5. Apparatus according to claim 1 further including a tension bar extending along the edge of the fabric to be over-sewn so that the over-sew stitch is formed over said tension bar.

6. Apparatus according to claim 5 in which said tension bar is adjustably mounted so as to draw more thread over the over-sew stitch.

7. Apparatus according to claim 5 whereby after said needle is withdrawn through said fabric, it is then extended forwardly over said fabric and over said tension bar whereupon said thread guide wraps said thread around said needle and said needle again withdraws over said tension bar forming an over-sew stitch over the edge of said fabric.

* * * * *

UNITED STATES PATENT OFFICE

CERTIFICATE OF CORRECTION

Patent No. 4,174,670 Dated November 20, 1979

Inventor(s) Ronald G. Birkhamshaw

It is certified that error appears in the above-identified patent and that said Letters Patent are hereby corrected as shown below:

In Column 4, line 42, Claim 3, after the word "claim" delete "1" and insert therefore --2--

In Column 4, line 53, Claim 6, after the word "thread" delete "over" and insert therefore --for--

Signed and Sealed this

*Sixth* Day of *May 1980*

[SEAL]

*Attest:*

SIDNEY A. DIAMOND

*Attesting Officer*

*Commissioner of Patents and Trademarks*